United States Patent [19]

Creamer et al.

[11] 4,142,950

[45] Mar. 6, 1979

[54] APPARATUS AND PROCESS FOR ELECTROLYSIS USING A CATION-PERMSELECTIVE MEMBRANE AND TURBULENCE INDUCING MEANS

[75] Inventors: Edward D. Creamer, Bolingbrook; Michael Krumpelt, Naperville, both of Ill. Jacob Jorné, Birmingham, Mich.

[73] Assignee: BASF Wyandotte Corporation, Wyandotte, Mich.

[21] Appl. No.: 850,344

[22] Filed: Nov. 10, 1977

[51] Int. Cl.[2] ..... C25B 1/46; C25B 11/03; C25B 13/08; C25B 9/00

[52] U.S. Cl. ..... 204/96; 204/258; 204/265; 204/266; 204/284; 204/290 R; 204/296

[58] Field of Search ..... 204/252-258, 204/283, 266, 284, 275, 261, 265, 237, 263, 96, 290 R, 296

[56] References Cited

U.S. PATENT DOCUMENTS

| | | | |
|---|---|---|---|
| 2,925,371 | 2/1960 | Van Winckel et al. | 204/261 X |
| 3,660,259 | 5/1972 | Danly et al. | 204/237 X |
| 3,676,315 | 7/1972 | Goens et al. | 204/284 X |
| 3,770,612 | 11/1973 | Gray et al. | 204/261 |
| 3,910,827 | 10/1975 | Raetzsch et al. | 204/283 X |
| 3,930,981 | 2/1976 | De Nora et al. | 204/284 X |
| 3,989,615 | 11/1976 | Kiga et al. | 204/283 X |
| 4,025,405 | 5/1977 | Dotson et al. | 204/258 X |
| 4,065,376 | 12/1977 | Whyte et al. | 204/275 X |

*Primary Examiner*—John H. Mack
*Assistant Examiner*—D. R. Valentine
*Attorney, Agent, or Firm*—Andrew E. Pierce; Bernhard R. Swick; Robert E. Dunn

[57] ABSTRACT

High current efficiency can be obtained in an electrolytic cell by inducing turbulence in the catholyte preferably by utilizing a gas-directing cathode and cation-permselective membrane combination. There is disclosed a process for electrolysis, particularly, the electrolysis of an alkali metal chloride such as sodium chloride to produce chlorine and sodium hydroxide. Said cell has a cathode and an anode divided into catholyte and anolyte compartments by a cation-permselective membrane. Turbulence inducing means such as a gas-directing cathode provides turbulence in said catholyte at the surface of said membrane by directing gas evolving on said cathode toward or away from said membrane. Multicell arrangements are also disclosed wherein said cells are connected in series.

16 Claims, 3 Drawing Figures

Fig-1
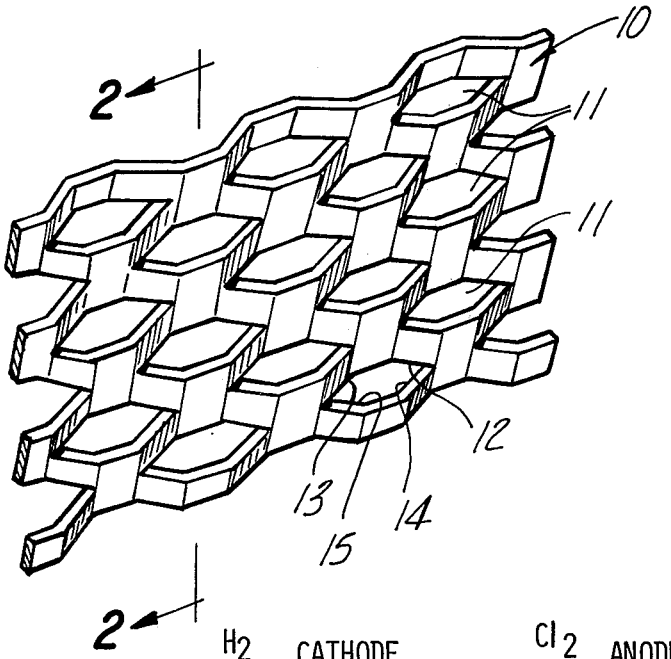
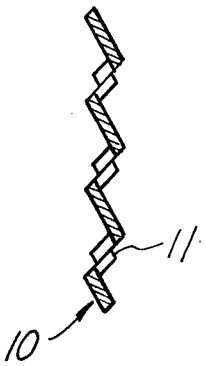
Fig-2
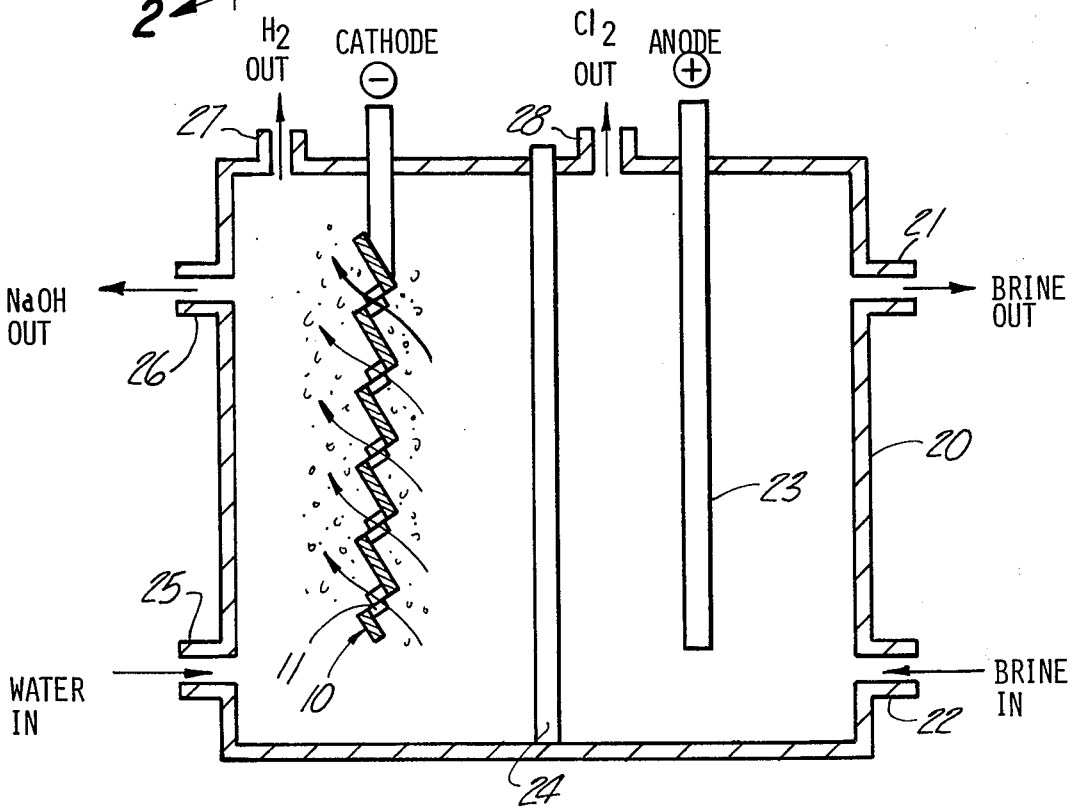
Fig-3

APPARATUS AND PROCESS FOR ELECTROLYSIS USING A CATION-PERMSELECTIVE MEMBRANE AND TURBULENCE INDUCING MEANS

BACKGROUND OF THE INVENTION

1. Field of the Invention

The present invention relates to electrolytic cells and particularly to the electrolysis of brine utilizing a cation-permselective membrane.

2. Description of the Prior Art

It is known to obtain increased current efficiency in a process for the electrolysis of brine wherein cation-permselective membranes are utilized to separate an anode and a cathode in a three-compartment electrolysis cell by reducing the concentration gradient on the cell membrane as disclosed in U.S. Pat. No. 3,220,941 wherein current efficiency of such a cell is improved by utilizing sodium carbonate between the two membranes of said cell. Improved current efficiency in a diaphragm cell has also been disclosed in U.S. Pat. No. 3,932,261 by means of the use of electrodes composed of supported foraminous metal sheets.

It is also known from U.S. Pat. No. 3,773,634 that in cation-permselective membrane electrolysis cells for the production of chlorine and sodium hydroxide that maximum current efficiency is obtained by operating the cell at a critical sodium hydroxide concentration of 31–43%.

Various gas-directing electrodes are known for use in electrolytic cells, for instance, reduced operating voltage is obtained according to U.S. Pat. No. 3,168,458 where perforated electrodes are utilized which allow for the transfer of liquid from one side of the electrode to the other. High current efficiency is obtained, according to the teaching of U.S. Pat. No. 3,598,715, in an electrolytic cell for the production of sodium chlorate having an expanded metal cathode in which the gas evolved thereon is directed away from the inter-electrode gap.

There is disclosed in German Offen. No. 2,419,204, an increase in efficiency of the electrodes in a diaphragm cell for the electrolysis of brine is obtained where inclined plates are positioned at the electrodes functioning to guide the gas evolved thereon toward the middle of the electrode chamber for release. A similar design is disclosed in British Pat. No. 1,460,357 and U.S. Pat. No. 3,930,151. In U.S. Pat. No. 3,930,981, a diaphragm cell for the electrolysis of brine is disclosed having perforated metal anodes and baffles to direct anode gases away from the inter-electrodic gap in order to protect the diaphragm against erosion.

The effect of gas evolution at the electrodes on the current overpotential relation and current distribution in diaphragm type electrolytic cells has recently been discussed in the *Journal of Applied Electrochemistry*, Vol. 6,(1976) pages 171–181. The polarization of a permeable membrane surface in a multicell electrodialysis apparatus is disclosed in U.S. Pat. No. 2,948,668 wherein alternating anion-permeable and cation-permeable membranes are separated by corrugated perforated spaces so as to cause strong turbulence in the flow of liquid through the cell in order to overcome said polarization.

In no one of the above-discussed references is there recognition of the fact that, in a cell for the electrolysis of brine utilizing a cation-permselective membrane, there is a hydroxide ion concentration gradient on the catholyte side of the membrane. At the membrane surface there is a substantially higher concentration of hydroxide ions than in the remaining bulk of the catholyte. The higher concentration of the hydroxide ions on said membrane leads to a lower current efficiency than would otherwise be obtained. The electrolysis method and electrolysis cell apparatus disclosed herein is effective in reducing this concentration gradient and thus increasing the current efficiency of said cell as compared to those of the prior art.

While it is known from U.S. Pat. No. 3,616,444 that so called "gas blinding" of the electrodes in an electrolytic cell for the production of sodium chlorate results in an increased electrical resistance between the anode and cathode of said cell, it is unexpected that the induced turbulent flow between the catholyte and the cell membrane of the electrolytic cell disclosed herein results in increased current efficiency.

It is thus seen that the prior art teaching in the field of the electrolysis of brine to produce chlorine and sodium hydroxide has failed to recognize both (1) the cation-permselective membrane concentration polarization phenomena (wherein hydroxyl ions are present in excess on the catholyte side of the membrane as compared with hydroxyl ions present in the bulk of the catholyte) and (2) the beneficial effect on cell current efficiency obtained by inducing turbulence in the catholyte near the surface of the cell membrane preferably by either directing the evolved cathodic gases away from or toward the permselective membrane of said cell.

SUMMARY OF THE INVENTION

In accordance with the present invention there is disclosed a vertical electrode electrolytic cell apparatus and a process for electrolysis, particularly the electrolysis of an alkali metal chloride such as brine to produce sodium hydroxide, chlorine and hydrogen wherein improved current efficiency is obtained by reducing the hydroxyl ion polarization on the surface of a cation-permselective membrane utilized in said electrolytic cell. Said polarization is effectively overcome by inducing turbulence in the catholyte liquor between the cathode and said cation-permselective membrane. The process of the invention provides at any given weight concentration of sodium hydroxide in the catholyte, a means of reducing the amount of anion (hydroxyl ion) passing through the membrane by reducing the weight concentration of the hydroxyl ion on the surface of the membrane. Since the weight concentration of sodium hydroxide in the catholyte is directly proportional to the extent of back-migration of hydroxyl ion through the permselective membrane and thus the electrolysis efficiency of the cell, the process of the invention provides increased current efficiency in the cell. Both single cell and multicell arrangements having a plurality of anodes, cathodes, anolyte and catholyte compartments separated by a plurality of cation-permselective membranes are contemplated. Where multicell arrangements are utilized, said cells are preferably connected in series.

The turbulence which is induced in the catholyte at the surface of said membrane is preferably achieved by utilizing a gas-directing cathode wherein the gas evolved upon the cathode is directed toward or away from said membrane. Said cathode is preferably an expanded metal sheet having an open mesh network of interconnected webs or filaments, said webs being positioned at an angle of about 20° to about 70° to the plane of said sheet. Other means of inducing turbulence in the catholyte include but are not limited to recirculation of the catholyte, for instance, by pumping and agitation of the catholyte by mechanical means, for instance, by stirring.

DESCRIPTION OF THE DRAWINGS

The invention will be more fully described by reference to an example of an embodiment thereof shown in the accompanying diagrammatic drawings.

FIG. 1 is a perspective view of a portion of one embodiment of the electrode utilized in the novel process of this invention.

FIG. 2 shows a cross-section taken along line 2—2 of FIG. 1.

FIG. 3 is a schematic diagram of a two-compartment electrolytic cell for the electrolysis of brine utilizing a cation permselective membrane and a gas directing cathode.

DESCRIPTION OF THE PREFERRED EMBODIMENTS

The process of the present invention is preferably practiced using an apparatus comprising a combination of a gas-directing cathode and a cation-permselective membrane in an electrolysis cell, particularly a chlor-alkali cell for the electrolysis of an alkali metal chloride such as brine to produce sodium hydroxide, chlorine and hydrogen. The process is also generally adapted for use in the electrolysis of other materials, organic and inorganic. In such membrane cells, generally an enclosure is provided which is divided into two compartments by said membrane. In one compartment thereof, the catholyte compartment, there is disposed a cathode having a particular structure, as will be described hereinafter. In the other compartment, the anolyte compartment, there is disposed solid or flattened or unflattened expanded metal anode composed of a conductive electrolytically active material such as graphite or more desirably an anode known in the prior art as a dimensionally stable anode, for instance, a titanium substrate bearing a coating of a precious metal, precious metal oxide or other electrolytically active, corrosion resistant material. Said anode can be in the form of a gas-directing, turbulence-inducing anode.

While any suitable membrane can be used, the present invention is preferably practiced using a hydrolyzed cation-permselective membrane made of a copolymer of tetrafluoroethylene and a fluorosulfonated perfluorovinyl ether such as a copolymer of tetrafluoroethylene and sulfonyl fluoride perfluorovinyl ether. Such membrane materials are sold for use in chlor-alkali cells under the trademark "Nafion". The membranes ordinarily have a thickness on the order of 0.1 to 0.4 millimeter.

In the operation of the chlor-alkali cell, a direct current is passed between the electrodes causing the generation of chlorine at the anode and the selective transport of hydrated sodium anions across said membrane into the catholyte compartment. These sodium ions combine with hydroxide ions formed at the cathode by the electrolysis of water to produce sodium hydroxide; hydrogen gas also being liberated at the cathode. The cation-permselective membrane is not a perfect barrier to anions, and therefore, allows a certain number of anions to pass in the opposite direction.The amount of anion (hydroxyl ion) passing through said membrane determines the hydroylsis efficiency or the amount of electrical energy required to produce a given quantity of chlorine and caustic.

The concentration of hydroxide ion in the cathode compartment of the cell which is related to the extent of back-migration of the hydroxyl ions through the cation-permselective membrane, results in a certain number of hydroxyl ions passing through the membrane thus allowing the formation of oxygen and other less valuable products in the anolyte, thereby reducing the current efficiency of the cell.

The tendency of hydroxyl ions to back-migrate through the membrane can be diminished (and the current efficiency increased) by feeding additional water to the catholyte compartment. A weaker caustic results thereby, for instance, one having as little as 25 to 50 grams per liter concentration. The production of so weak a caustic in the catholyte of the cell is generally too great a price to pay for the improved current efficiency obtained since the dilute caustic produced must eventually be concentrated by evaporation prior to marketing and use.

IN THE DRAWINGS

Referring now to FIG. 1 of the drawing, there is illustrated one embodiment of a gas-directing cathode 10 utilized in the process of this invention which comprises an unflattened, expanded-metal. Where an electrode is used as a cathode 10 it is generally made of nickel coated steel or nickel (coating not shown in the drawing) wherein the nickel coating exists at least on the face or front of the cathode 10 which is directed toward the cation-permselective membrane 24. The coated face of each cathode 10 is mounted opposite an anode 23 in the electrolysis cell as illustrated in FIG. 3. The anode 23 can be either solid or flattened or unflattened expanded metal and is generally made of a corrosion resistant metal such as titanium having a coating of a precious metal oxide. The cathode 10 shown is provided with diamond-shaped openings 11 in which the top half section consisting of sides 12 and 13 of each diamond is pushed forwardly of the vertical center plane of the cathode 10 and the bottom half section consisting of sides 14 and 15 of each diamond-shaped opening 11 is pushed rearwardly of the vertical center plane of the cathode 10. The corners of each diamond-shaped opening situated between sides 12 and 13, and the corresponding sides 14 and 15 lie approximately in the vertical plane of the cathode. The bottom half section, consisting of sides 14 and 15, of each diamond-shaped opening 11 is tilted or pushed toward the back of the cathode 10 (the side not facing the cation-permselective membrane 24) while the top half section, consisting of sides 12 and 13, of each diamond-shaped opening 11 is tilted or pushed toward the front of the cathode 10 so that gas which is released on both halves of the diamond-shaped opening 11 pass through said opening to the back of the cathode 10 and are deflected rearwardly by the tilted top half of the cathode 10 and into the electrolyte space between the cathode 10 and the cell wall 20 as indicated in FIG. 3.

The shaded portions of the cathode 10, which is depicted in schematic form in FIGS. 2 and 3 in a cross-sectional view, are the top (sides 12 and 13) and the bottom (sides 14 and 15) half sections of the expanded metal cathode 10 surrounding the openings 11 in the cathode 10.

Referring again to FIG. 3 of the drawing, there is illustrated in schematic form a cross-sectional view of one embodiment of an electrolytic cell of the invention comprising a cell wall 20, a flattened, expanded metal anode 23, a gas-directing expanded metal cathode 10 and a cation-permselective membrane 24. Conductive means for connecting the anode and cathode to sources of positive and negative electrical potentials, respectively, are not shown. An aqueous solution of alkali metal chloride, preferably acidic, is fed through line 22 and exits from line 21. Water is fed in through line 25 and sodium hydroxide solution is obtained through line 26. During electrolysis, chlorine gas is removed through line 28 and hydrogen gas is correspondingly removed through line 27. The electrolysis is conducted at high caustic current efficiency by maintaining the gas-directing, expanded metal cathode 10 in relation to the cation-permselective membrane 24 such that the hydrogen gas evolved on the cathode 10 is directed rearwardly (as shown) or forwardly toward the cation-permselective membrane 24 so as to induce turbulent flow between said membrane 24 and said cathode 10. Thus a high concentration sodium hydroxide solution can be obtained through line 26 while at the same time maintaining high caustic current efficiency.

THE PERMSELECTIVE MEMBRANE

In general, any cation-permselective membrane, which is electrolytically conductive in the hydrated state, which exists under electrolytic cell conditions can be utilized in the process of the invention. As previously noted, the preferred membrane material is sold under the trademark "Nafion." Said material is a copolymer having structural units of the formula:

$$-\!\left[(CF_2)_n-\underset{\displaystyle O-CF_2-CF(CF_3)-O-CF_2-CF_2-SO_3H}{\underset{|}{CF}}\right]-$$

This copolymer generally has an equivalent weight of from about 900 to about 1600, preferably from about 1100 to about 1500. Such copolymers are prepared as disclosed in U.S. Pat. No. 3,282,875, incorporated herein by reference, by reacting at a temperature below about 110° C. a perfluorovinyl ether with tetrafluoroethylene in an aqueous liquid phase, preferably at a pH below 8 in the presence of a free radical initiator such as ammonium persulfate. Subsequently, the acyl fluoride groups of the copolymer are hydrolyzed to the free acid or salt form using conventional means. Other ion exchange membranes can be used which are resistant to the heat and corrosive conditions exhibited in such cells. Generally these membranes are utilized in the form of a thin film which can be deposited on an inert support such as a cloth woven of polytetrafluoroethylene, or the like or can have a thickness which can be varied over a considerable range, generally thicknesses of from about 0.1 to about 0.4 millimeter being typical. Preferably, the membrane is a composite structure composed of a 0.038 millimeter coating of said copolymer having an equivalent weight of about 1500 on one side of said woven polytetrafluoroethylene cloth and a 0.1 millimeter to 0.13 millimeter coating of said copolymer having an equivalent weight of about 1100 on the opposite side of said woven cloth. The membrane can be fabricated in any desired shape. The copolymer sold under the trademark "Nafion" is preferably fabricated to the desired dimension in the form of the sulfonyl fluoride. In this non-acid form, the copolymer is soft and pliable and can be heat-sealed to form strong bonds. Following shaping or forming to the desired configuration, the material is hydrolyzed. The sulfonyl fluoride groups are converted to free sulfonic acid or sodium sulfonate groups. Hydrolysis can be effected by boiling the membrane in water or alternatively in caustic alkali solution.

After the hydrolysis step described above, the cell membrane is desirably subjected to a heat treatment at 100° C. to 275° C. for a period of several hours to 4 minutes so as to provide improved selectivity and higher current efficiency, i.e., lower energy consumption per unit of product obtained from the chlor-alkali cell. In addition, the aqueous alkali metal hydroxide solution is obtained having a lower salt concentration when the membrane is treated in this manner. The treatment can consist of placing the membrane between electrically heated flat plates or in an oven where said membrane is suitably protected by placing slightly larger thin sheets of polytetrafluoroethylene, for instance, on either side of the membrane. Satisfactory results have been obtained in the treatment where no pressure has been exerted on the membrane during the heat treatment but it is desirable to use a small pressure on the membrane during the heat treatment step. The duration of the heat treatment is dependent upon the temperature used for the treatment and can be as short a time as 4 to 5 minutes where a temperature of 275° C. is utilized. Further details of the heat treatment of the membranes used in the practice of the present invention are disclosed in copending, commonly assigned applications, Ser. No. 619,606, filed Oct. 6, 1975 and Ser. No. 729,201, filed Oct. 4, 1976 and incorporated herein by reference.

THE ELECTRODES

The anodes can be solid, flattened expanded metal or gas-directing anodes such as unflattened, expanded metal anodes. They can be made of materials having surface coatings of noble metal, noble metal alloys or noble metal oxides, for instance, ruthenium oxide and mixtures thereof with titanium dioxide on a substrate which is conductive such as titanium. Platinum is an especially useful coating on a titanium anode. Preferably, dimensionally stable anodes are utilized as exemplified by a ruthenium oxide-titanium dioxide coating on a titanium substrate.

Bipolar electrodes can also be employed. Those having skill in the art will know the variations in structure that will be made to accommodate bipolar rather than monopolar electrodes in such cells and, therefore, these changes in structure need not be described in detail. Of course, as is known in the art, pluralities of individual cells can be employed in multicell units having common feed and product manifolds and being housed in unitary structures. Such constructions are also known in the art and need not be discussed herein.

The expanded metal, gas-directing cathodes generally can be made of any electrically conductive material which will resist the attack of the contents of the cell. Such materials are, for instance, nickel, steel and iron. Titanium or noble metal coatings on steel or other conductive substrate as well as metals such as platinum, iridium, ruthenium or rhodium are especially useful as coatings. Nickel and the noble metals can be deposited as surface coatings by plasma or flame spraying, electrodeposition or electroless coating on suitable conductive substrates, for instance, copper, silver, steel and iron.

The cathodes are preferably nickel coated, steel cathodes which can be prepared in accordance with procedures known to those skilled in the art or with procedures disclosed in copending, commonly assigned application Ser. No. 658,538, filed Feb. 17, 1976 in the U.S. Patent Office and incorporated herein by reference. By the process of this application, a steel cathode can be coated with a dense, non-porous, electroless nickel coating by immersing said steel cathode in a bath at a suitable temperature; the bath containing a suitable nickel salt, water, a complexing agent and a reducing agent. Considerable savings in power in the electrolysis of brine in a chlor-alkali cell are achieved by the use of such electrodes.

The preferred nickel coated, steel cathodes can also be prepared in accordance with copending, commonly assigned application Ser. No. 611,030, filed Sept. 8, 1975 in the U.S. Patent Office and incorporated herein by reference. By the process of this application, a steel cathode can be coated with nickel by either flame-spraying or plasma-spraying the powdered metal onto the steel cathode surface.

The expanded metal, gas-directing cathodes, include means for directing the gas evolved from the cathode during electrolysis toward or away from the cation-permselective membrane of the cell. Utilizing these cathodes, the evolved gas is deflected from its natural upward path between the cathode and the cation-permselective membrane thus causing turbulent flow of the catholyte to occur in the area between the cathode and said membrane. The expanded metal, gas-directing cathode is formed of a sheet of metal which is characterized as a continuous fabric mesh having an open mesh network of interconnected webs or filaments enclosing openings of diamond shape, although oval or other shaped openings can be used. The webs are, in general, flat in cross-section and are positioned at an angle of about 20° to about 70°, preferably about 35° to about 55° to the plane of the original sheet from which they are formed. Such sheets of expanded metal are known to those skilled in the art for use as electrodes in chlor-alkali electrolysis cell technology and are shown in FIGS. 1, 2 and 3 of the drawings herein and further described in the prior art, for instance, in U.S. Pat. Nos. 3,598,715 and 3,930,981, which are hereby incorporated by reference. The size of the openings in said cathodes can be, for instance, from about 3/16 inch × ½ inch to about ⅜ inch × 1¼inch (height and width of the opening, respectively).

THE PROCESS CONDITIONS

The electrolysis process of the invention is generally adapted for use in the electrolysis of organic as well as inorganic materials. Preferably the electrolysis solution contains chloride ions and is a water solution of at least one alkali metal chloride such as sodium chloride. Other soluble or partially soluble salts or hydroxides are useful in aqueous solution. For instance, sodium sulfates, sulfites or phosphates can also be utilized, at least in part. In water electrolysis, sodium hydroxide and potassium hydroxide can be used. Sodium chloride is the preferred alkali metal chloride for the production of chlorine and caustic since sodium chloride, as well as potassium chloride, do not form insoluble salts or precipitates and produce stable hydroxides. The concentration of sodium chloride in a brine which is charged to the anolyte compartment of the cell will usually be as high as feasible, generally at least about 200 to about 340 grams per liter of sodium chloride and about 200 to about 360 grams per liter of potassium chloride with intermediate figures for mixtures. The anolyte can be neutral or acidified to a pH in the range of about 1 to about 6, preferably about 2 to about 4, and most preferably about 3 to about 4, acidification normally being effected by utilizing a suitable acid such as hydrochloric acid. The anolyte is desirably acid to effect neutralization of any hydroxyl ions entering the anode compartment from the catholyte thus preventing the formation of oxygen.

The temperature of the electrolyte is generally maintained at less than 105° C., preferably between about 20° C. to about 95° C., and most preferably about 65° C. to about 95° C. The temperature of the electrolyte can be increased by recirculation of portions thereof and by the proper regulation of the proportion of feed to the anolyte. Alternatively, cooling of the electrolyte can be effected by exposure of the anolyte liquid to ambient conditions before entry or re-entry of such liquid into the anolyte of the cell.

The weight percent of salt conversion in the anolyte of the cell is determined by dividing the weight concentration of the alkali metal chloride in the anolyte effluent by the weight concentration of the alkali metal chloride in the solution which is continuously added to the anolyte, correcting for the water of hydration transported across the membrane and multiplying by 100. Generally, the weight percent salt conversion is about 50% to about 85%, preferably about 65% to about 75%. Preferably, an alkali metal chloride brine containing about 300 to about 340 grams per liter is continuously added to the anode compartment of the cell and the depleted brine removed.

The concentration by weight of the caustic solution made in the cell is from about 10% to about 40% and is free of chloride or essentially free thereof, often containing as low as 0.1 to 10 grams per liter of chloride and usually about 1 gram or less per liter. As is known to those skilled in the art, the caustic concentration can be further increased by evaporation of water and because of the unusually high concentration of caustic obtained directly from the cell very little additional energy in the form of heat is required to raise the concentration to a desirable, marketable concentration of about 50% by weight.

The electrical operating conditions of the cell can vary over a wide range. Cell voltages are generally about 2.9 to about 5 volts and current density is generally about 0.75 to about 3 amperes per square inch. Theoretically, it has been determined that in prior art electrolytic cells utilizing cation-permselective membranes, a reduction in current efficiency occurs as a result of the increase in hydroxide concentration on the surface of the membrane which amounts to a 2.5% to 7.5% reduction in current efficiency. By the process disclosed herein comprising the use of an expanded metal, gas-directing cathode to induce turbulence between the cathode and the cation-permselective membrane of the cell, increased current efficiency results as the hydroxide ion concentration at the surface of the membrane is reduced from about 1 to about 3 moles per liter less than the theoretically calculated increased ionic concentration present at the surface of said membrane which is in contact with the catholyte.

The walls of the electrolytic cells utilized in the process disclosed herein can be formed of any suitable electrically non-conductive material having resistance to chlorine, hydrochloric acid and sodium hydroxide at the temperatures at which the cell is operated. Suitable materials have been found to be coated metals, chlorinated polyvinyl chloride, polypropylene containing up to 40% of an inert, fibrous filler such as asbestos or talc, chlorendic acid-based polyester resins, phenol-formaldehyde resins and the like. Preferably, the materials of construction have sufficient rigidity to be self-supporting.

The following examples illustrate the various aspects of the invention but are not intended to be limiting. Where not otherwise specified throughout the specification and claims, temperatures are given in degrees centigrade and parts, proportions and percentages are by weight.

EXAMPLE 1

This example illustrates the use of the electrolytic cell of the invention in the electrochemical conversion of an aqueous solution of sodium chloride to sodium hydroxide and chlorine. An electrolytic cell body was constructed of chlorinated polyvinyl chlorine plastic containing 20 percent by weight of asbestos based upon the total weight of said filled plastic. The cell is schematically shown in FIG. 3 and contained a cathode assembly as schematically shown in FIG. 2. The cell contained a flattened expanded metal anode made of ruthenium oxide-coated titanium and a cathode made of nickel coated steel. The electrodes communicate with current sources by means of steel members. The cathode was shaped into a turbulence inducing form by expanding a metal sheet by stamping out openings between the remaining webs or filaments of the mesh which measure ⅜ inch high by 1¼ inches wide; the remaining metal filaments being about 2 millimeters in thickness. The electrodes were mounted in the cell on either side of a cation-permselective membrane so as to provide an electrode spacing of 0.1 inch with the cathode installed so as to direct cathodic gases away from the membrane.

The membrane was manufactured by E. I. du Pont de Nemours & Company, Inc., and sold under the trademark "Nafion," type 313. The membrane was joined to a backing or supporting layer network of polytetrafluoroethylene filaments woven into a cloth having an area percentage of openings therein of about 22% by volume. The membranes which were initially flat are fused onto the polytetrafluoroethylene cloth under conditions of high temperature and pressure with some of the membrane portions actually being caused to flow around the filaments of the cloth during the fusing so that the membrane and cloth become an integral unit. Before being sold, the membrane was hydrolyzed by boiling in water. It has been found that heating the membrane at about 200° C. for about 2 hours is required to allow the attainment of a desirable base level of current efficiency after installation of the membrane in the electrolytic cell. The cation-permselective membrane utilized was in two layers each bonded together and consisting of a hydrolyzed copolymer of a perfluorinated hydrocarbon and a fluorosulfonated perfluorovinyl ether; the outer layer being 2 mil in thickness and having an equivalent weight of about 1350 and the inner layer being 4 mil in thickness and having an equivalent weight of about 1100.

Ruthenium oxide coated titanium anodes were used which were prepared by coating a titanium mesh having about 2 millimeter thickness filaments with about 50% by volume open area with ruthenium oxide to a thickness of about $10^{-3}$ millimeters.

The cell was operated under the following conditions:

Current density: 200 amperes per square foot
Cell voltage: 3.25 to 3.85 volts
Temperature: 82° C. to 88° C.
pH in the anolyte: 3 to 3.5

During the operation of the cell, saturated brine was fed to the anode compartment at a rate to consume 60% by weight of the brine with no recycling of the brine used. Water was fed to the cathode compartment at a rate to produce approximately 5 normal sodium hydroxide and caustic concentration was determined accurately within ±0.5% by weight by repeatedly accumulating known volumes of catholyte in the amount of 0.22 liter over a time interval of about 2 hours. Concurrent with the collection of these known volumes, an integrated sample was accumulated using a metering pump and subsequently titrated to determine the normality of the sodium hydroxide solution within ±0.5%, the caustic current efficiency was calculated utilizing the following equation:

$$\text{Current Efficiency (NaOH)} = \frac{\text{(NaOH normality) (flow rate, liters/hr)}}{\text{current, amps}} \times 2681$$

An overall accuracy of ±1.2% was obtained in the calculation of the current efficiency.

The cell was operated continuously for a period of 10 days.

Results obtained show a current efficiency average of 82% for the cell.

EXAMPLE 2

Example 1 is repeated except that said turbulence inducing cathode is positioned so as to direct cathodic gases toward said membrane. An average value for current efficiency of the cell is comparable to results obtained in the cell of Example 1.

EXAMPLES 3 and 4 (COMPARATIVE EXAMPLES)

A cell forming no part of this invention was operated in accordance with the above procedure with the exception that the expanded-metal cathode utilized was a flattened, expanded-metal cathode so that turbulence on the surface of the cation-permselective membrane is not induced by directing the evolving cathodic gases toward or away from said membrane. A flattened, expanded-metal cathode having openings measuring 3/16 inch in height by ½ inch in width was utilized in addition to a flattened, expanded metal electrode having larger ⅜ inch high by 1¼ inch wide openings. Current efficiencies obtained utilizing said cells having flattened, expanded-metal electrodes present as cathodes indicate a current efficiency average of 77%. These comparative examples indicate that in the absence of turbulence-inducing, expanded-metal cathodes in the cell, the current efficiency of the cells is decreased.

EXAMPLES 5 and 6

Examples 1 and 2 are repeated except that the anode used is an expanded metal anode shaped into a turbulence inducing form by expanding a metal sheet of ruthenium oxide-coated titanium by stamping out openings between the remaining webs of filaments of the mesh which measure ⅜ inch high by 1¼ inches wide. The anode is positioned in the cell so as to direct evolving gases away from the cell membrane. Average values for current efficiency is comparable to the results obtained in the cell of Example 1.

The invention has been described with working examples and other illustrative embodiments but it is not intended that the invention be limited to these embodiments since it is evident that one of ordinary skill in the art will be able to utilize substitutes and equivalents without departing from the spirit and scope of the invention.

The embodiments of the invention in which an exclusive property or privilege is claimed are defined as follows:

1. An electrode and cation-permselective membrane combination capable of providing high current efficiency in an electrolytic cell comprising a cathode and an anode and catholyte and anolyte compartments divided by said permselective membrane wherein said cathode is a gas-directing expanded metal cathode having an open mesh network of interconnected webs, a portion of said webs being positioned at an angle to the plane of said cathode and adapted to induce turbulence in the catholyte of said electrolytic cell by directing gases evolved on said cathode toward or away from the surface of said permselective membrane.

2. The combination of claim 1 wherein said electrolytic cell is adapted for the electrolysis of an alkali metal chloride in a vertical electrolytic cell.

3. The combination of claim 2 wherein said gas-directing cathode is adapted to direct gases evolving thereon during said electrolysis away from said cation permselective membrane and said alkali metal chloride is sodium chloride.

4. The combination of claim 2 wherein said cathode is adapted to direct the gases evolved on said cathode during said electrolysis toward said cation permselective membrane and said alkali metal chloride is sodium chloride.

5. The combination of claim 3 wherein a plurality of said electrode-permselective membrane combinations are utilized in a multicell arangement and wherein said cells are connected in series.

6. A vertical cation-permselective membrane electrolytic cell of high current efficiency comprising (a) an anode and a cathode, (b) an anolyte and a catholyte compartment separated by an electrolytically conductive, hydraulically impervious cation-permselective membrane wherein said cathode is a gas-directing, expanded metal cathode sheet having an open mesh network of interconnected webs with a portion of said webs being positioned at an angle to the plane of said cathode sheet and adapted to induce turbulence in the catholyte of said cell by directing gases evolving thereon toward or away from the surface of said cation-permselective membrane.

7. The cell of claim 6 wherein said cell is adapted for use in the electrolysis of an alkali metal chloride solution and wherein said anode is a flattened expanded metal sheet or an unflattened expanded metal sheet.

8. The cell of claim 7 wherein said cathode is adapted to direct gas evolved at said cathode away from said cation permselective membrane and said alkali metal chloride is sodium chloride.

9. The cell of claim 7 wherein said cathode is adapted to direct gas evolved at said cathode toward said cation permselective membrane and said alkali metal chloride is sodium chloride.

10. The cell of claim 8 wherein said cell contains a plurality of anodes, cathodes, anolyte and catholyte compartments separated by a plurality of cation-perselective membranes and said anodes and cathodes are connected in series.

11. In a process for electrolysis of an alkali metal chloride in a vertical electrode electrolytic cell having as electrodes an anode and a cathode and anolyte and catholyte compartments separated by an electrolytically-conductive, hydraulically-impervious cation-permselective membrane wherein said anode is a flattened expanded metal, the improvement comprising inducing turbulence by providing as the cathode of said cell, a gas-directing, expanded metal electrode having an open mesh network of interconnected webs, a portion of said webs being positioned at an angle to the plane of said sheet and adapted to induce turbulence in the catholyte of said electrolytic cell by directing gases evolving thereon toward or away from the surface of said cation-permselective membrane resulting in an increase in the current efficiency of said cell.

12. The process of claim 11 wherein said gas-directing cathode is adapted to direct gas evolved on said cathode toward said cation-permselective membrane and wherein said alkali metal chloride is sodium chloride.

13. The process of claim 11 wherein said gas directing cathode is adapted to direct gas evolved at said cathode away from said cation-permselective membrane and wherein said alkali metal chloride is sodium chloride.

14. The process of claim 13 wherein said cation-permselective membrane is a hydrolyzed copolymer of tetrafluoroethylene and fluorosulfonated perfluorovinyl ether having an equivalent weight of about 1100 to about 1500.

15. The process of claim 14 wherein said expanded metal cathode is selected from the group consisting of a plasma sprayed nickel coated steel cathode, a steel cathode, an electroless-nickel plated steel cathode or a solid nickel cathode.

16. The process of claim 15 wherein said cathode has openings therein having a diamond shape and said webs are positioned at an angle to the plane of said sheet of about 20° to about 70°.

* * * * *